US007001195B2

(12) United States Patent
Fleetwood, III et al.

(10) Patent No.: US 7,001,195 B2
(45) Date of Patent: Feb. 21, 2006

(54) IGNITION LEAD WITH REPLACEABLE TERMINAL CONTACT

(75) Inventors: Charles T. Fleetwood, III, Easley, SC (US); Michael A. Runge, Piedmont, SC (US)

(73) Assignee: Champion Aerospace Inc., Liberty, SC (US)

( * ) Notice: Subject to any disclaimer, the term of this patent is extended or adjusted under 35 U.S.C. 154(b) by 0 days.

(21) Appl. No.: 10/851,399

(22) Filed: May 21, 2004

(65) Prior Publication Data

US 2005/0009395 A1 Jan. 13, 2005

Related U.S. Application Data

(60) Provisional application No. 60/472,606, filed on May 22, 2003.

(51) Int. Cl.
*H01R 13/62* (2006.01)

(52) U.S. Cl. ..... 439/320; 439/891; 439/700; 439/824

(58) Field of Classification Search ..... 439/320, 439/700, 824, 891, 289
See application file for complete search history.

(56) References Cited

U.S. PATENT DOCUMENTS

| | | | | |
|---|---|---|---|---|
| 2,913,696 | A | 11/1959 | Burgher | |
| 3,533,046 | A * | 10/1970 | Banning | 439/289 |
| 4,266,841 | A | 5/1981 | Sherwood | |
| 4,427,252 | A * | 1/1984 | Lee et al. | 439/320 |
| 4,978,309 | A | 12/1990 | Straub | |
| 5,083,932 | A | 1/1992 | Wyatt et al. | |
| 6,077,132 | A * | 6/2000 | Gligorijevic | 439/891 |

* cited by examiner

*Primary Examiner*—Tho D. Ta
(74) *Attorney, Agent, or Firm*—Reising, Ethington, Barnes, Kisselle, P.C.

(57) ABSTRACT

An ignition lead that includes at least one terminal assembly having a replaceable terminal contact that provides a simple means of replacing worn contacts without removal and replacement of the entire ignition lead. The terminal assembly includes the replaceable contact which threads onto a contact body located within a tubular insulator. A retaining ring attaches to the contact to hold the insulator in place over the contact body. The contact can include a groove that extends around the contact to receive the retaining ring. Replacement of the contact involves removing the retaining ring from the groove in the contact, sliding the insulator off the terminal assembly, unthreading the worn contact, threading on a replacement contact, reassembling the insulator onto the assembly, and then securing the insulator in place by snapping the retaining ring back into the groove on the replacement contact.

20 Claims, 2 Drawing Sheets

IGNITION LEAD WITH REPLACEABLE TERMINAL CONTACT

CROSS-REFERENCE TO RELATED APPLICATION

This application claims the priority of U.S. Provisional Patent Application No. 60/472,606 filed May 22, 2003, the entire contents of which are hereby incorporated by reference.

TECHNICAL FIELD

The present invention relates generally to ignition leads used with igniters in reciprocating and gas turbine engines and, more particularly, to the terminal contacts used on such ignition leads.

BACKGROUND OF THE INVENTION

An ignition lead is a high voltage cable (typically 2–25 kV) used to deliver high voltage ignition pulses from an ignition system to some type of ignition device, which in turn uses the ignition pulses to generate sparks for igniting a fuel/air mixture. Due to the high voltage involved, electrical contacts of the ignition lead are susceptible to damage and often wear out before the other ignition lead components. Two such contacts are the terminal contacts located at each end of the ignition lead, one of which is a first terminal contact connecting a component of the ignition system, such as an exciter circuit, to the insulated center wire of the ignition lead, and the other of which is a second terminal contact connecting the center wire to an ignition device, such as a spark plug or igniter. With many ignition lead designs, if either of these terminal contacts become worn out, a time consuming and costly maintenance procedure is required to replace them.

Conventional ignition lead terminal contacts are not replaceable. Thus, when the contact wears out, the entire terminal assembly, or worse yet, the entire ignition lead may need to be replaced. This is particularly costly in applications having ignition leads of great length, sometimes exceeding twenty-five feet or more. Moreover, the time required by a skilled mechanic to replace an entire ignition lead, particularly in a gas turbine application, can be as much as four hours in some instances.

Replaceable terminal contact assemblies for ignition leads are known in the art, an example of which is built by Champion Aerospace Inc. of Liberty, S.C., for ARP670 type 2f termination. This replaceable contact assembly 10 is shown in FIG. 1 and generally includes a contact body 12 and a replaceable tubular connector 14. Contact body 12 is a generally cylindrical metallic component having a blind hole 20 extending into an upper axial end and a threaded male portion 22 extending from a lower axial end. The blind hole is designed to permanently receive the stranded center wire 24 of the ignition lead by crimping the contact body around the wire and firmly retaining it in place (as demonstrated by the illustrated deformation of contact body 12). The exterior threads of male portion 22 are threaded into replaceable tubular connector 14, which generally includes a longitudinal bore 30 having a threaded female portion 32 located at its upper axial end and an opening 34 located at its lower axial end. The threads of male portion 22 are sized to fit those of female portion 32 such that the replaceable tubular connector 14 can be threadingly attached and removed from the permanently attached contact body 12.

Opening 34 is sized to receive an electrode of an igniter such that the high voltage pulse passing through contact assembly 10 is transmitted to the igniter. Other components, such as an insulator 36 and various connection pieces, are also seen in the drawing and are well known in the art. According to this design, when the terminal contact needs replacement, the tubular connector 14 is simply unthreaded from the contact body and a new connector is installed.

It is a general object of the invention to provide a replaceable contact assembly that can be used not only for ARP670 type 2f termination, but also for a wide variety of other types of ignition lead termination including, for example, other ARP670 termination designs.

SUMMARY OF THE INVENTION

The present invention provides an ignition lead and a replaceable terminal contact therefor, as well as a method of manufacturing the ignition lead and replacing the terminal contact. The ignition lead includes at least one terminal assembly having a replaceable contact that is threaded or otherwise removably attached to a contact body located within a tubular insulator. A retaining component attaches to the replaceable contact to hold the insulator in place over the contact body. The terminal contact itself includes a connecting feature, such as threads at one end of the contact, to permit it to be secured to the contact body, and the contact can include a groove that extends at least partially around the contact at a location intermediate the two ends of the contact. Replacement of the contact involves removing the retaining component, sliding the insulator off the terminal assembly, disconnecting the worn contact, removably attaching a replacement contact, reassembling the insulator (or a replacement one) onto the assembly, and the securing the insulator in place by reattaching the retaining component (or a replacement one) onto the replacement contact.

BRIEF DESCRIPTION OF THE DRAWINGS

A preferred exemplary embodiment of the invention will hereinafter be described in conjunction with the appended drawings, wherein like designations denote like elements, and wherein.

DETAILED DESCRIPTION OF THE PREFERRED EMBODIMENTS

The terminal assembly described herein utilizes a replaceable contact for one or more terminal ends of the center wire of an ignition lead. For a standard ignition lead having two ends each with a connector, the replaceable terminal design described below can be used at one or both of the connectors. The ignition lead can be used with various ignition circuit components such as an exciter circuit or an ignition device such as a spark plug or an igniter; however, these are but a few of the components that could be used in connection with the ignition lead described herein. Furthermore, the terminal assembly can be used in conjunction with a wide array of engines, but is particularly advantageous when used with either an aircraft reciprocating or gas turbine engine. Because the present invention is primarily concerned with the contact portion of the disclosed terminal assembly, no description is provided for the other components seen in the figures, or for the other portions of the ignition lead not shown in the figures. Such other components and portions of the ignition lead are known to those skilled in the art.

Figure 1:
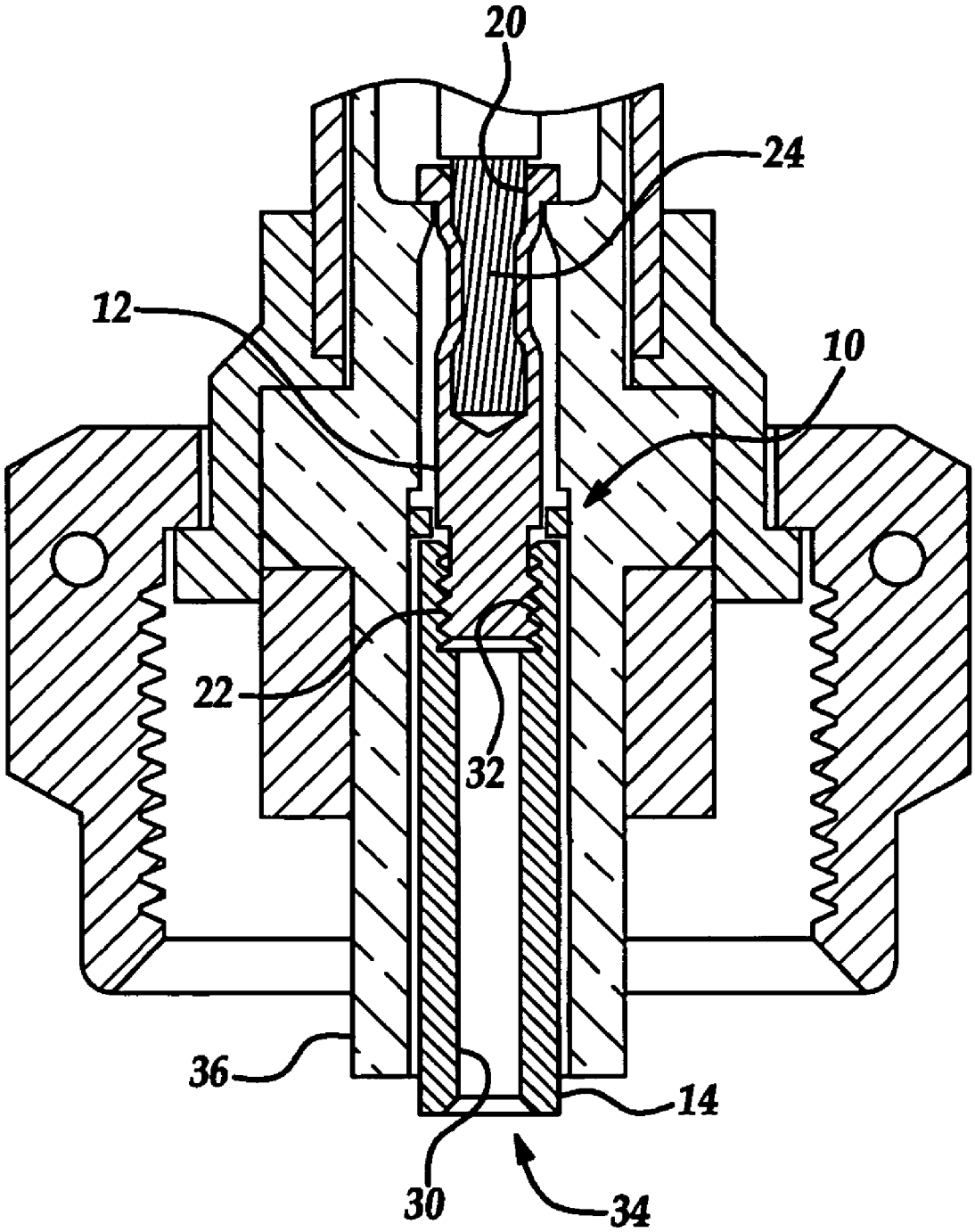
Figure 1 Prior Art
FIG. 1 is a cutaway view of a prior art replaceable ignition lead terminal assembly.
Figure 2:
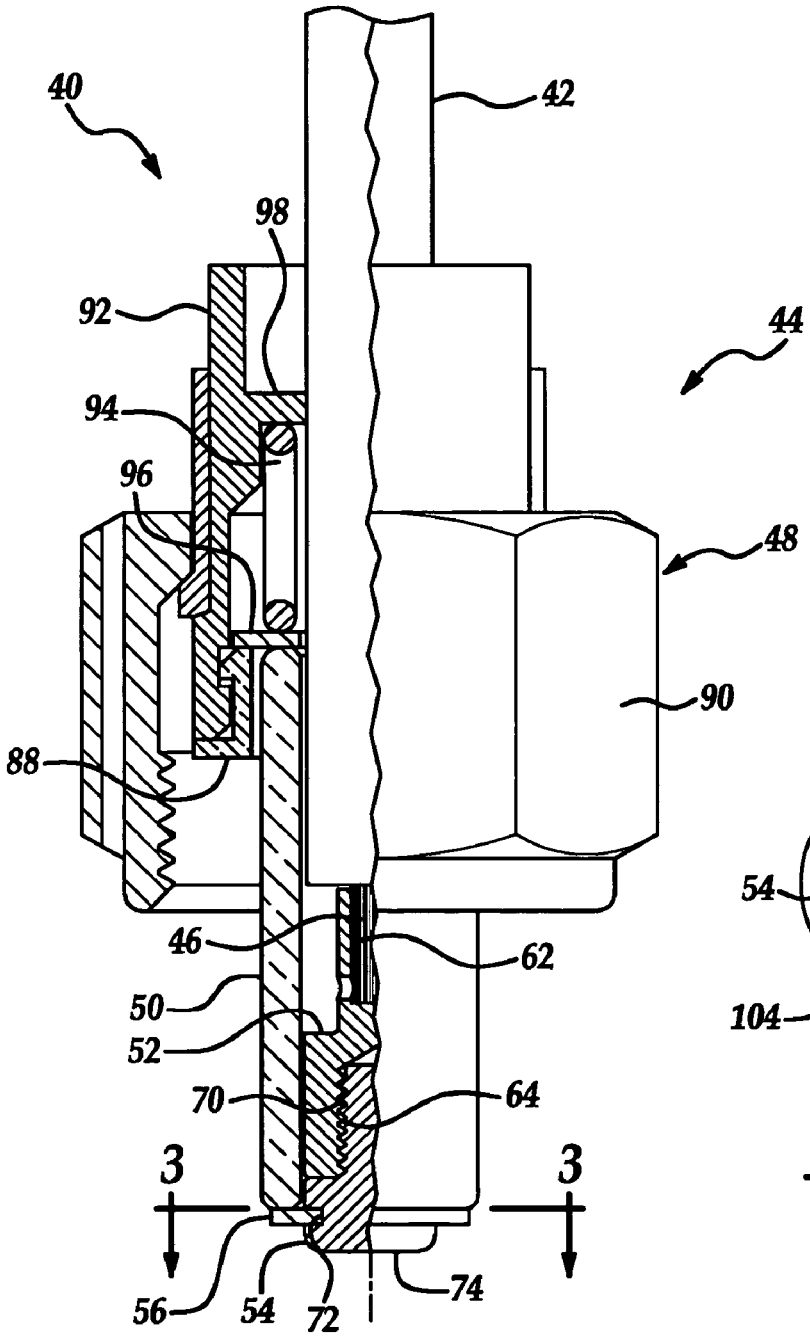
FIG. 2 is a cutaway view of a preferred embodiment of an ignition lead terminal assembly of the present invention.

Referring now to FIG. 2, an embodiment of the present invention is shown in the form of an ignition lead 40 that includes an insulated center wire 42 and a terminal assembly 44. Center wire 42 can be solid core or stranded wire, and includes a bare terminal end 46. Terminal assembly 44 includes a connector 48 along with a tubular insulator 50 that provides electrical isolation between the connector 48 and the terminal contact components. These components include a contact body 52 securely attached to the center wire 46, a replaceable contact 54 threaded onto the contact body 52, and a retaining component 56 which maintains the insulator 50 in place over the terminal contact components.

Contact body 52 is a generally cylindrical, electrically conductive metallic component designed to couple center wire 46 of the ignition lead 40 to the replaceable contact 54. Contact body 52 can be made from 303 stainless steel or any other suitable material. The contact body generally includes a first blind bore 62 at an upper axial end and a second blind bore 64 at a lower axial end. The upper blind bore 62 is designed to receive the bare end 46 of the center wire and permanently attaches over the exposed end 46 by brazing, crimping, or any other suitable means. By "permanently" it is meant that the components are secured by any means of connection that is not intended to be removable, such as by crimping, soldering, brazing, or conductive adhesive. This is to be contrasted with the term "removably" which, as used herein, means that the components are secured together in a manner that permits subsequent separation of the components without damaging or substantially deforming them. This can include the threaded connection of the illustrated embodiment as well as snap fit connections or mating connections that utilize a third component to maintain the parts together.

This permanent connection of the center wire 46 and contact body 52 forms a secure mechanical and electrical connection. At the opposite axial end of the contact body 52 is the lower blind bore 64. This bore is provided with internal (female) threads for connecting to replaceable contact 54. It is worth noting that the contact body shown here is simply a preferred embodiment that has been provided for exemplary purposes and to which numerous modifications could be made. For instance, instead of having two blind bores 62 and 64, each of which only extends inwardly by a certain axial length, there could be a single longitudinal bore that extends the entire axial length of the contact body such that it accommodates both the center wire 46 and replaceable contact portion 54. Furthermore, rather than providing a contact body with a female portion and a replaceable contact with a male portion, the contact body could be equipped with a downwardly extending male portion and, in turn, the replaceable contact would have the female portion. These are just a few of the modifications that can be utilized without departing from the scope of the present invention.

Replaceable contact 54 is an electrically conductive component designed to couple contact body 52 to an ignition device or other circuitry such that the contact 54 may be easily replaced. Preferably, the replaceable contact is a plug-like component generally including a threaded axial end 70, a circumferential groove 72 and a contact surface 74. As previously discussed, threaded axial end 70 is a male portion designed to thread into female portion 64 such that the two components are firmly, yet removably attached to one another. These threads on contact 54 are a connecting feature of that component which permits it to be removably attached to the contact body 52, and it will be understood that snap connections and other types of connecting features can be used without departing from the scope of the invention. The circumferential groove 72 extends around the outer surface of the replaceable contact portion at a location intermediate the two ends 70, 74 of the contact. This groove 72 is sized to receive retaining component 56. Thus, the exact shape and size of the groove is largely dependent upon the particular retaining component used. Contact surface 74 is the surface to or from which the high voltage ignition pulse either enters or leaves the ignition lead, depending on whether terminal assembly 44 is being used to couple the ignition lead to an ignition circuit or an ignition device, respectively. This surface is susceptible to pitting, corrosion and other consequences of high voltage use, and is typically the portion of the ignition lead that wears out first and needs replacement. Preferably, this contact 54 is made from Inconel™ 600. If desired, precious metal inserts or other arc resistant or Corona resistant materials can be used to improve the operation and/or functionality of the terminal assembly 44. Again, the specific embodiment of replaceable contact 54 shown here has been provided as an example with numerous other variations being possible. For example, the threaded end 70 or the entire replaceable contact 54 could be plated to help prevent thread seizure or to affect other attributes of the contact. Contact surface 74 could be convex, concave, pointed, or have one of numerous other contours. Furthermore, the circumferential groove need not extend entirely around the outer surface of the contact, but could vary from that shown in order to accommodate retaining rings of numerous designs, shapes and sizes, as will now be discussed.

Figure 3:
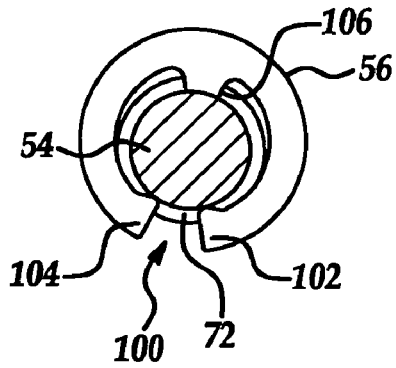
FIG. 3 is a sectional view along lines 3—3 showing the retaining ring of the ignition lead terminal assembly of FIG. 2.
Figure 4:
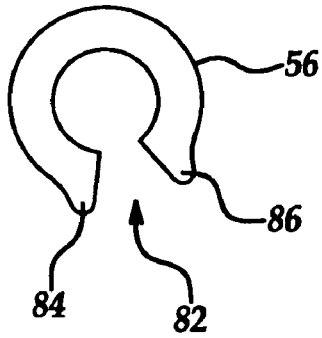
FIG. 4 is a top-down view of an alternative embodiment of a retaining ring that may be used in the ignition lead terminal assembly of FIG. 2.

In the illustrated embodiments, retaining component 56 comprises a retaining ring, or snap ring, that snaps into groove 72. The retaining ring 56 is formed from a resilient metallic material such as PH 15-7MO which is known in the art, and it attaches to the replaceable contact 54 such that it maintains the cylindrical insulator 50 in place. According to the embodiment shown in FIG. 3, the retaining component 56 is an E-ring that includes an opening 100, end tangs 102 and 104, and a center tang 106. During installation of the retaining component, end tangs 102 and 104 are spread, preferably by manual force, such that opening 100 is made large enough to fit around the replaceable contact 54 and firmly seat within groove 72. Once installed in groove 72, the end tangs 102, 104 and center tang 106 are the only portions of the E-ring that contact the outer surface of the replaceable contact 54, which, as seen in FIG. 3, has a circular cross-section. The E-ring embodiment of FIG. 3 is but one example of the type of retaining component that could be used. Alternative retaining components, such as gapped, continuous, and other standard retaining rings offered by ring manufacturers such as Smalley Steel Ring Co., could also be used with the terminal assembly 44. For instance, FIG. 4 shows an alternative retaining component embodiment that is in the form of a C-ring. This C-ring embodiment operates largely the same as that of FIG. 3, but includes an opening 82 and end tangs 84, 86. As indicated in the Figure, the C-ring does not include a center tang. Both the E-ring and C-ring embodiments of the retaining component 56 are free to rotate within groove 72.

The function of the retaining ring 56 is to captively hold the insulator in place over the otherwise exposed high voltage components; namely, the bare end 46 of the center wire, the contact body 52, and the upper portion of contact 54. The insulator is retained in place between the retaining ring 56 and a portion of the terminal assembly 44. More specifically, the connector 48 includes a hex 90 and coupler 92 that secures the hex 90 to the insulated center wire 42, while permitting rotation of the hex 90 so that the terminal assembly 44 can be threaded onto a mating component, be it an ignition device or a mating socket connector. Housed within the coupler 92 is a spring 94 and a washer 96. The spring 94 extends about the center wire 42 between a back wall 98 of the coupler and the washer 96. This spring is, but need not be, under compression so that it presses washer 96 and, thus insulator 50, axially toward retaining ring 56. When the terminal assembly 44 is coupled to an ignition device, such as an igniter or spark plug, this axial force against the retainer ring causes replaceable contact 54 to firmly press against the terminal contact of the ignition device with which the terminal assembly is coupled; a significant contact-to-contact load is desirable. As will be appreciated by those skilled in the art, when connector 48 is tightened onto an ignition device or other mating socket connector, spring 94 is forced into greater compression which helps retain the insulator 50 tightly in place and improves the contact-to-contact load mentioned above. To hold the spring 94 and washer 96 in place during removal of the contact 54 and insulator 50, a spring retainer 88 is used to snap into the coupler 92. Spring retainer can be made from copper alloy C11000. The other components of connector 48 can be made of suitable materials that will be known to those skilled in the art.

Having described in detail the construction of the terminal assembly 44 for ignition lead 42, it will be appreciated that the ignition lead can be manufactured using a suitable assembly process, such as the following. First, the connector 48 with all of its components is assembled onto the end of the insulated center wire 42. Then, the contact body 52 is permanently attached to the bare end 46 of the center wire. The terminal contact 54 is then threaded onto the contact body. The insulator 50 is then placed over the contact body 52 and is secured in place by attaching the retaining ring 56 to the terminal contact. This last step can be done by snapping the retaining ring 56 into the groove 72, although it will be appreciated that other retaining components that attach to the contact 54 in other ways (so that no groove 72 is needed), can be used in lieu of retaining ring 56.

During replacement, a worn out contact 54 is removed from the terminal assembly 44 and a new one is installed. The first step in the replacement of a worn out contact 54 is to remove the retaining ring 56. Depending on the particular design of the retaining ring, removal can typically be accomplished with a pair of pliers or similar tool. In the both the E-ring and C-ring embodiments of FIGS. 3 and 4, respectively, a mechanic can grasp one or more of the end tangs 102, 104, 84, 86 with a pair of needle-nosed pliers or similar tool, and spread them apart so that the ring 56 can be pulled off of the worn out terminal contact 54. With the retaining ring removed, the tubular insulator 50 may simply be slid off of the terminal assembly 44, thereby exposing the contact body 52 and replaceable contact 54. With the exterior surface of both of these components exposed, the mechanic can grasp each of them with a tool, such as a wrench, and unscrew the replaceable contact 54 from the contact body 52. A new replacement contact 54 is then threaded onto contact body 52 and torqued to a desired value. Subsequently, the original insulator or a replacement one is slid back over top of terminal assembly 44, against the downward spring bias of spring 94, and pushed upwards such that the retaining ring 56 may again be installed within the circumferential groove. Either the original retaining ring 56 or a replacement one can be used. A significant advantage of this arrangement is that the total replacement time for a worn contact can be as short as fifteen minutes, although the actual replacement time can of course be dependent on a variety of factors.

It will thus be apparent that there has been provide in accordance with the present invention an ignition lead and replaceable terminal contact therefor which achieves the aims and advantages specified herein. It will, of course, be understood that the foregoing description is of a preferred exemplary embodiment of the invention and that the invention is not limited to the specific embodiment shown. Various changes and modifications will become apparent to those skilled in the art. For example, although the contact body 52 is shown herein as being directly connected to the center wire 46, it will be appreciated that it can be connected to the center wire indirectly, such as via one or more other electrically conductive components. All such changes and modifications are intended to be within the scope of the present invention.

As used in this specification and appended claims, the terms "for example," "for instance," and "such as," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that necessarily requires a different interpretation.

What is claimed is:

1. A terminal contact for use with an ignition lead terminal assembly having a contact body, a removable tubular insulator, and a retaining ring for retaining the insulator on the terminal assembly, said terminal contact comprising:

an electrically conductive contact extending from a first end to a second end, said contact having a connecting feature at said first end to thereby permit said contact to be removably connected to the contact body of the terminal assembly, said contact being sized to fit within at least a portion of the tubular insulator, and said contact further including a groove that receives the retaining ring, with said groove extending about said contact at a location intermediate said first and second ends, whereby said contact can be connected to the contact body with the retaining ring being snapped into said groove to hold the insulator on the terminal assembly.

2. A terminal contact as set forth in claim 1, wherein said connecting feature comprises a threaded male portion that threads into a threaded female portion of the contact body, said threaded male portion of said contact having a first diameter and said second end of said contact having a second diameter that is larger than said first diameter.

3. In an ignition lead having a plurality of terminal assemblies and an insulated center wire extending between two or more of said terminal assemblies, wherein at least one of said terminal assemblies comprises:

a connector secured to said insulated center wire;

an electrically conductive contact body electrically connected at a first end to said center wire and having a second end spaced from said first end;

a tubular insulator extending over said contact body such that said insulator provides electrical isolation of said contact body from said connector;

an electrically conductive replaceable contact having an axial end removably connected to said second end of said contact body, said contact further including a groove extending about at least a portion of an outer surface of said contact; and a retaining component disposed within said groove, wherein said insulator is captively held in position by said retaining component and another portion of said terminal assembly.

4. An ignition lead as set forth in claim 3, wherein said insulator is disposed over a portion of said insulated center wire.

5. An ignition lead as set forth in claim 3, wherein said retaining component comprises a retaining ring.

6. An ignition lead as set forth in claim 3, wherein said contact body is rigidly connected to a non-insulated terminal end of said center wire.

7. An ignition lead as set forth in claim 6, wherein said contact body is permanently attached to said terminal end of said center wire.

8. An ignition lead as set forth in claim 7, wherein said contact body is crimped onto said terminal end of said center wire.

9. An ignition lead as set forth in claim 3, wherein said other portion of said terminal assembly comprises a component of said connector.

10. An ignition lead as set forth in claim 9, wherein said component of said connector comprises a washer.

11. An ignition lead as set forth in claim 10, wherein said washer is spring biased such that said insulator is forced towards and into contact with said retaining component.

12. An ignition lead as set forth in claim 3, wherein said replaceable contact is threaded onto said contact body.

13. An ignition lead as set forth in claim 12, wherein said axial end of said contact comprises a threaded male portion.

14. An ignition lead as set forth in claim 13, wherein said second end of said contact body is a female portion threaded over said male portion.

15. An ignition lead, comprising:

an insulated center wire; and a terminal assembly, comprising:

a connector secured to an end of said insulated center wire;

an electrically conductive contact body permanently connected to said center wire and having a threaded portion;

a tubular insulator extending over said contact body such that said insulator provides electrical isolation of said contact body from said connector; and an electrically conductive replaceable contact having a first end threaded onto said contact body and a second end that forms a contact surface, whereby said replaceable contact is removably connected to said contact body;

wherein said replaceable contact extends at least partially out through one end of said tubular insulator, and wherein said tubular insulator is connected at said one end to said replaceable contact such that said insulator is prevented from moving axially away from said connector and off said contact body.

16. An ignition lead as set forth in claim 15, wherein said replaceable contact has an externally threaded portion at said first end, said contact having a diameter at said contact surface that is larger than the diameter of said threaded portion.

17. An ignition lead as set forth in claim 15, wherein said contact body has an internally threaded bore and said replaceable contact has an externally threaded portion that threads into said bore.

18. An ignition lead as set forth in claim 17, wherein said tubular insulator has an internal diameter, said contact body has an outer diameter at said threaded bore, and said replaceable contact has an outer diameter at an intermediate section adjacent said externally threaded portion, and wherein said outer diameters are approximately equal to said internal diameter of said insulator.

19. An ignition lead as set forth in claim 15, wherein said tubular insulator is connected to said replaceable contact via a retaining component.

20. An ignition lead as set forth in claim 19, wherein said replaceable contact has a groove and said retaining component comprises a retaining ring that snaps into said groove and that extends radially outwardly such that said retaining ring engages said one end of said insulator.

* * * * *